US005397141A

United States Patent [19]

Hoshizaki et al.

[11] Patent Number: 5,397,141

[45] Date of Patent: Mar. 14, 1995

[54] IN-LINE SKATE CONSTRUCTION

[75] Inventors: T. Blaine Hoshizaki, Montreal West; René Bourque, Laval; Bernard Daoust, Piedmont, all of Canada

[73] Assignee: Canstar Sports Group Inc., Ville Mont Royal, Canada

[21] Appl. No.: 159,220

[22] Filed: Nov. 30, 1993

[30] Foreign Application Priority Data

Jul. 30, 1993 [CA] Canada ..... 2101718

[51] Int. Cl.[6] ..... A63C 1/02; A63C 1/18; A63C 17/06

[52] U.S. Cl. ..... 280/11.3; 280/11.22; 36/115

[58] Field of Search ..... 280/11.22, 11.23, 11.3, 280/11.36; 36/115

[56] References Cited

U.S. PATENT DOCUMENTS

| | | | |
|---|---|---|---|
| 2,642,677 | 6/1953 | Yates | 280/11.3 X |
| 4,072,317 | 2/1978 | Pommerening | 280/11.3 X |
| 4,351,537 | 9/1982 | Seidel | 36/115 X |
| 4,418,929 | 12/1983 | Gray | 280/11.3 X |
| 4,844,491 | 7/1989 | Wheelwright | 280/11.3 X |
| 5,092,614 | 3/1992 | Malewicz | 280/11.3 X |
| 5,171,033 | 12/1992 | Olson et al. | 280/11.22 |
| 5,257,795 | 11/1993 | Babcock | 280/11.22 X |
| 5,295,701 | 3/1994 | Reiber et al. | 280/11.22 |
| 5,331,752 | 7/1994 | Johnson et al. | 280/11.22 X |

FOREIGN PATENT DOCUMENTS

| | | | |
|---|---|---|---|
| 2820681 | 11/1978 | Germany | 280/11.3 |

*Primary Examiner*—Brian L. Johnson
*Attorney, Agent, or Firm*—R. Craig Armstrong

[57] ABSTRACT

An in-line skate is shown, including a rigid plastic chassis having a main portion and integral wing portions extending upwardly therefrom on either side adjacent the heel end of the chassis, with an integral heel portion between the wing portions. The main portion, heel portion and wing portions together define a heel box area. A plastic boot is secured to the chassis inside the wing portions and against the heel portion, and extends forwardly along the chassis. A plastic cuff wraps around either side and the rear above the boot, and is pivotally connected to each wing portion. A soft flexible padded sock-like liner is positionable inside the boot and the cuff. Straps are provided to secure the cuff, boot and chassis around the liner to firmly secure the user's foot, the straps preferably including at least one strap passable across the front of a user's ankle, the opposite ends of the strap being directed generally towards the heel box area, such that tightening of the strap pulls a user's heel directly into the heel box area. Preferably, the boot is adjustable to toe in or out relative to the chassis, and the pivotal connection between the cuff and the wing portions includes a ribbed adjustment on at least one side, whereby the height of the cuff relative to the wing portion on that side may be adjusted. The cuff is positioned inside the wing portions, and the boot and the cuff are generally complementary in shape and thickness, thereby presenting generally flush interior surfaces to the liner.

5 Claims, 12 Drawing Sheets

IN-LINE SKATE CONSTRUCTION

BACKGROUND OF THE INVENTION

This invention relates to in-line skates.

In-line skating is quickly becoming very popular as a sport and recreational activity. Associated sports such as in-line hockey and competitive in-line racing have transformed in-line skating from a casual hobby into a rigorous sporting event. This transformation has increased the need for high-performance in-line skates.

In particular, there is a need for an in-line skate which can provide superior energy transfer from the user to the ground, through a relatively rigid construction, while meeting the somewhat conflicting goal of still being comfortable for the user. Such a skate is preferably adjustable in several respects so that the user can optimize comfort and performance.

It is thus an object of the invention to provide an in-line skate construction which provides better performance in terms of energy transfer than has hitherto been available, while maintaining or enhancing comfort and preferably providing adjustability in several respects.

SUMMARY OF THE INVENTION

In the invention, therefore, the skate employs a rigid plastic chassis having a main portion and integral wing portions extending upwardly therefrom on either side adjacent the rear or heel end of the chassis, with an integral heel portion between the wing portions. The main portion, heel portion and wing portions together define a heel box area. A plastic boot is secured to the chassis inside the wing portions and against the heel portion, and extends forwardly along the chassis. A plastic cuff wraps around either side and the rear above the boot, and is pivotally connected to each wing portion. A soft flexible padded sock-like liner is positionable inside the boot and the cuff. Straps are provided to secure the cuff, boot and chassis around the liner to firmly secure the user's foot.

Preferably, the straps include at least one strap passable across the front of a user's ankle, the opposite ends of the strap being directed generally towards the heel box area, such that tightening of the strap pulls a user's heel directly into the heel box area.

Preferably, the boot is secured to the chassis at forward and rear fastener locations, the forward fastener location including means such as a slotted hole so that the boot may be secured to the chassis in a range of lateral positions, thereby providing a variable toeing in or toeing out of the boot relative to the chassis.

Preferably, the pivotal connection between the cuff and the wing portions includes adjustment means on at least one side, whereby the height of the cuff relative to the wing portion on that side may be adjusted, thereby permitting adjustment of the degree of canting (pronation/supination).

Preferably, the cuff is positioned inside the wing portions, and the boot and the cuff are generally complementary in shape and thickness, thereby presenting generally flush interior surfaces to the liner.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION

Figure 1:
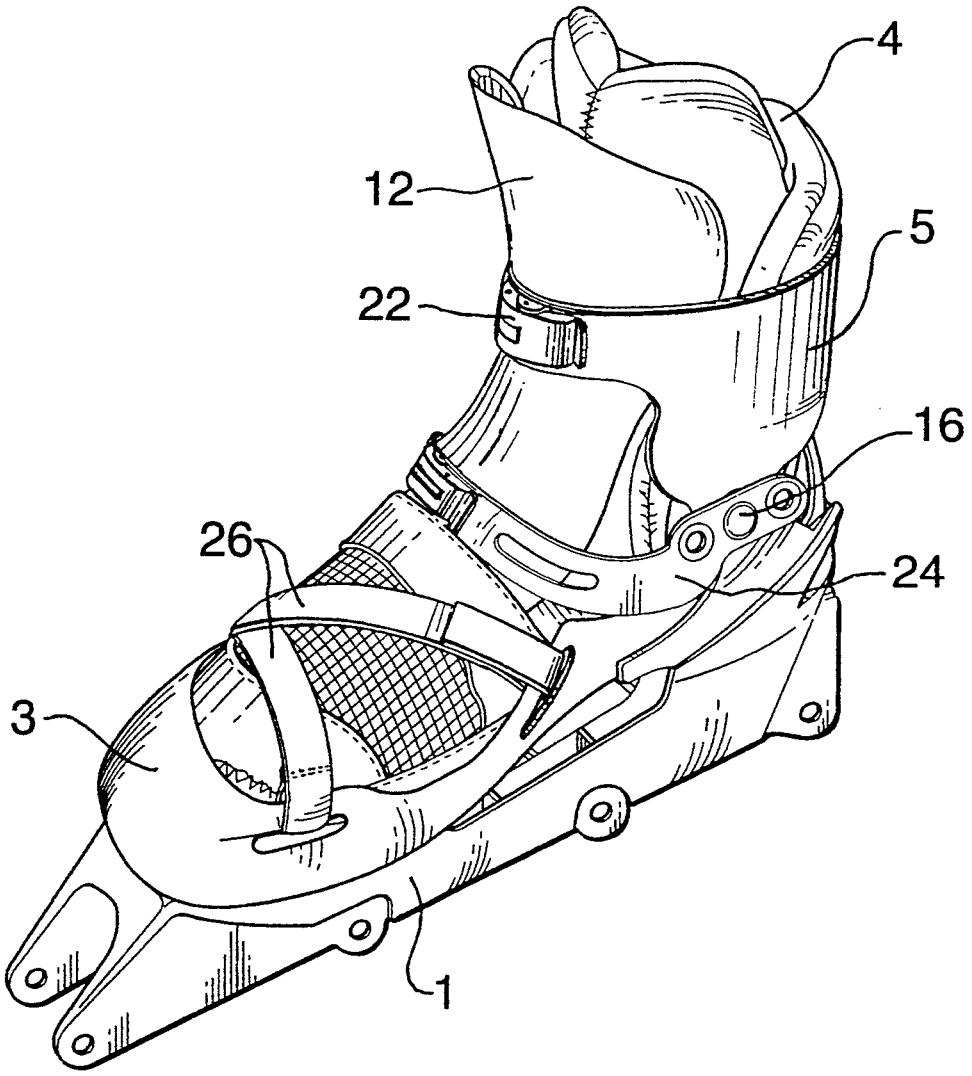
FIG. 1 is a perspective view of the preferred embodiment of the skate, for the right foot, with the wheels not shown.
Figure 2:
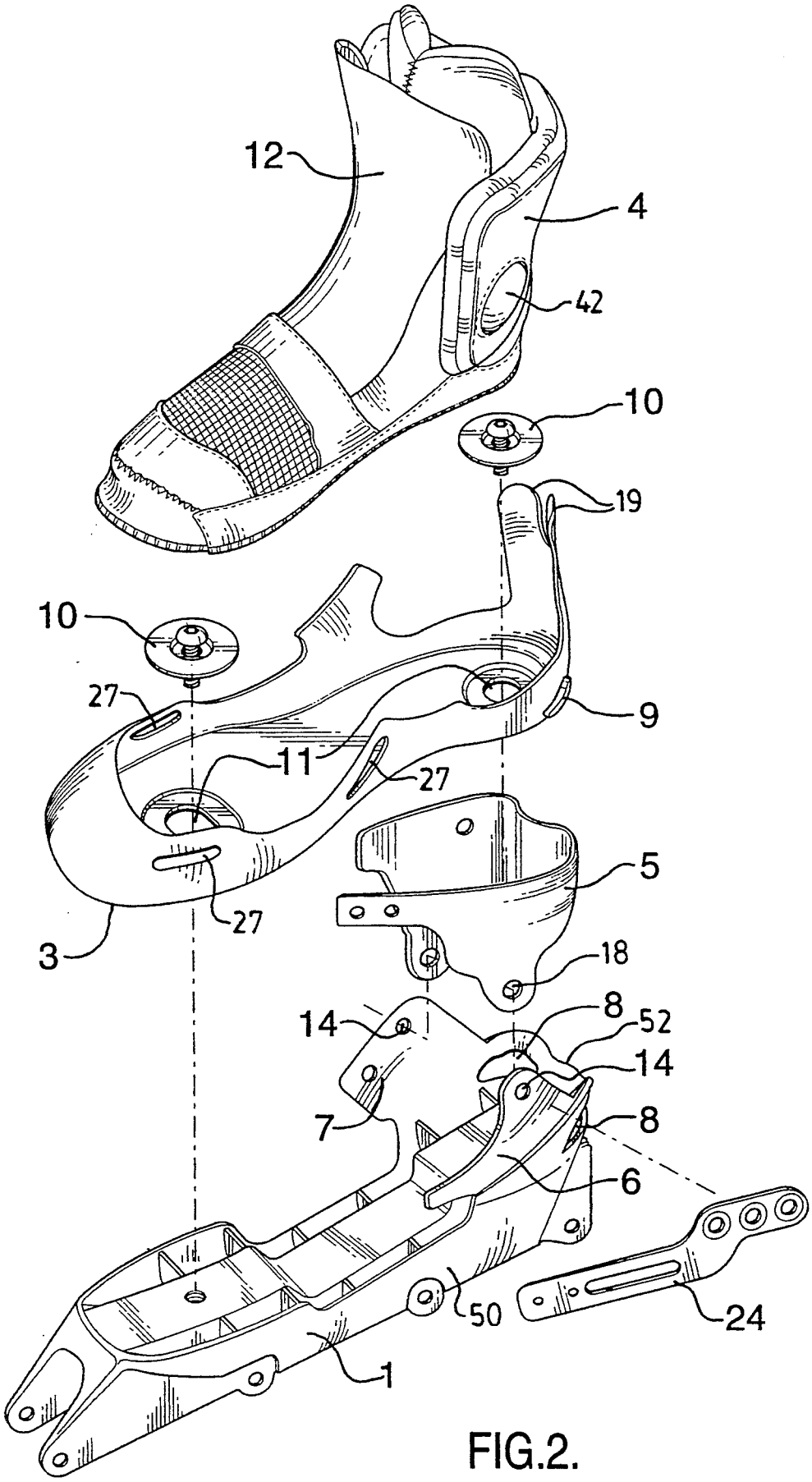
FIG. 2 is an exploded perspective corresponding to FIG. 1.
Figure 3:
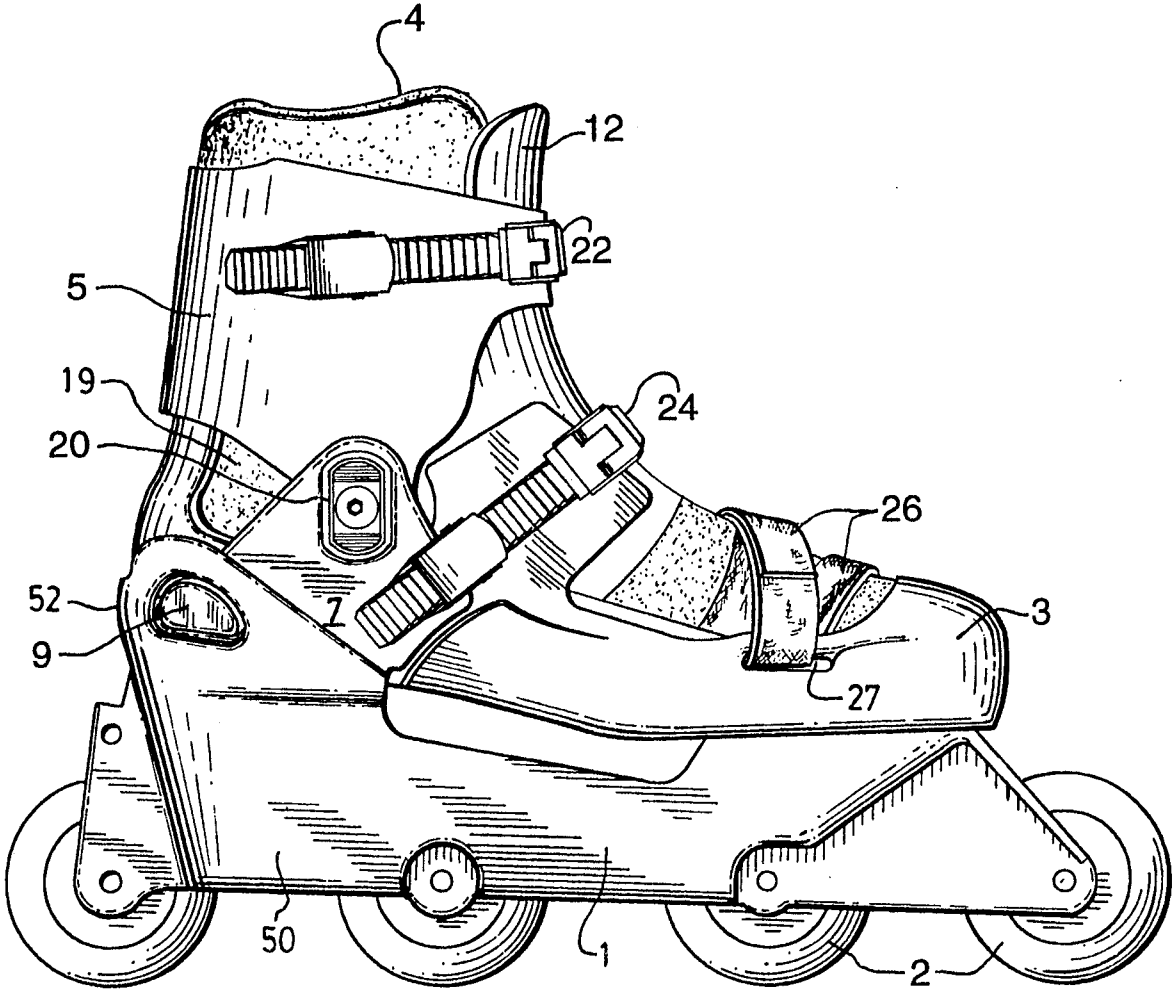
FIG. 3 is a side elevation view of the skate.
Figure 9:
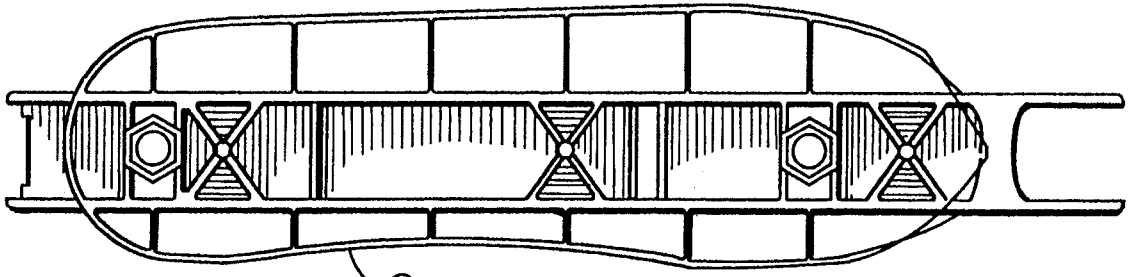
FIG. 9 is a bottom view of the chassis.
Figure 11:
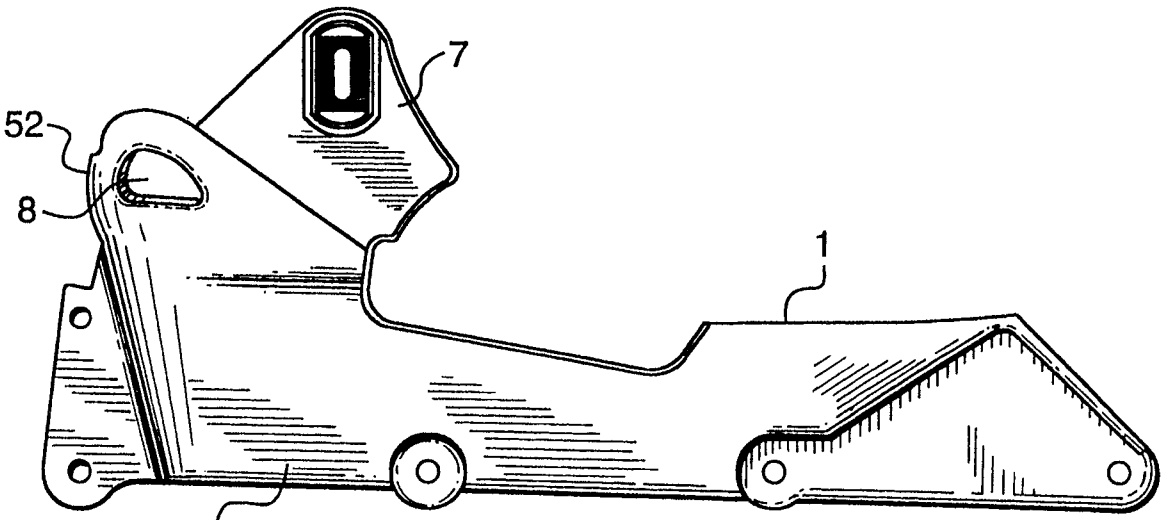
FIG. 11 is a side elevation view of the chassis.
Figure 10:
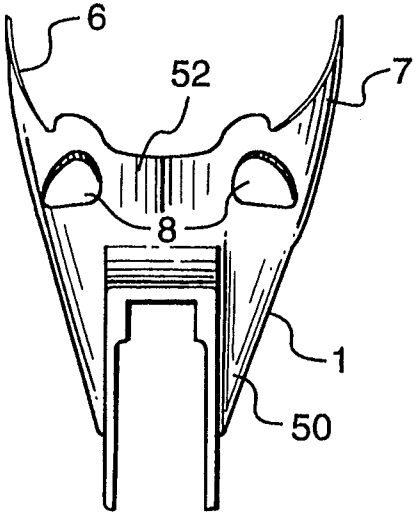
FIG. 10 is a rear view of the chassis.

Referring now to FIGS. 1, 2 and 3 primarily, the main components of the skate are: a chassis 1, which carries wheels 2; a boot 3; a liner 4; and a cuff 5. The chassis (shown by itself in FIGS. 9–11) includes a main portion or base 50, a heel portion 52, and medial and lateral wing portions 6 and 7 respectively, projecting upwardly adjacent the heel portion 52. The main portion, heel portion and wing portions together define a heel box area. The wing portions include cutout areas 8 to receive projections 9 which extend from the boot 3.

Figure 12:
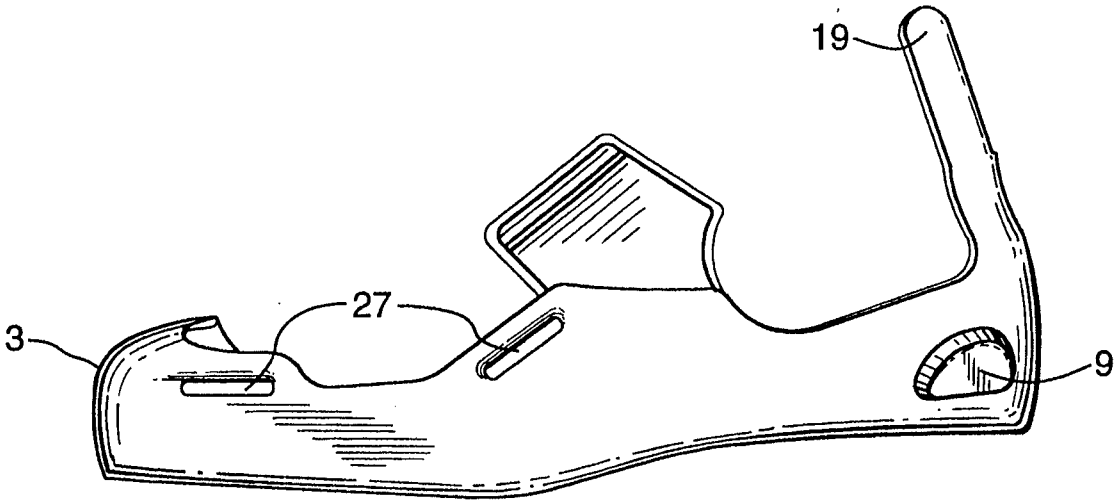
FIG. 12 is a side elevation view of the medial side of the boot.
Figure 13:
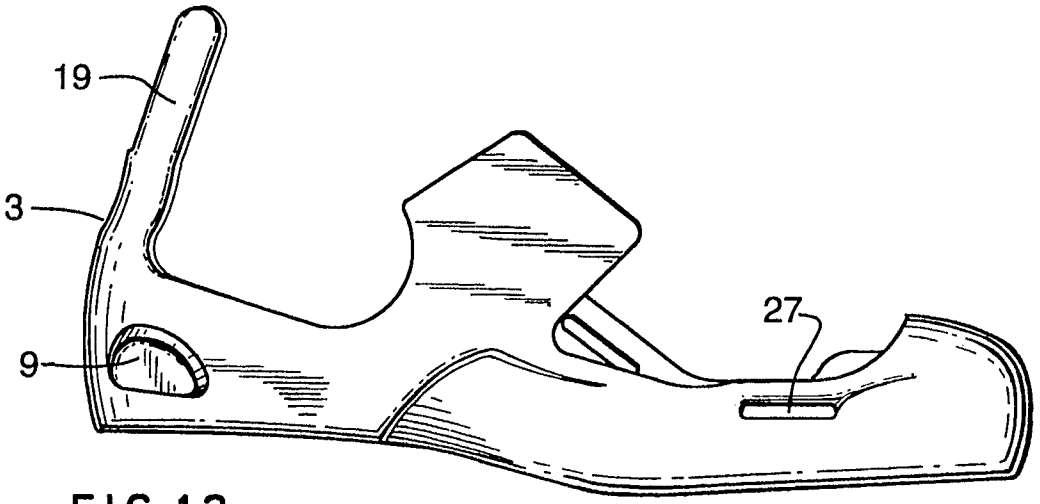
FIG. 13 is a side elevation view of the lateral side of the boot.

The boot 3 (shown by itself in FIGS. 12 and 13) is positioned above the chassis, between the wing portions 6 and 7, with the projections 9 positioned in the cutout areas 8. The boot is secured to the chassis by fore and aft bolts and washers 10 which pass through holes 11 in the sole of the boot. The forward one of the holes 11 is preferably elongated laterally so that the user may adjust the boot to toe in or toe out relative to the chassis, according to personal preference.

The liner 4 is a generally conventional flexible padded sock-like structure, including a plastic tongue 12, and preferably including a flowable gel-pack 42 in the region of the malleoli for greater comfort. The liner fits within the boot 3.

Figure 4:
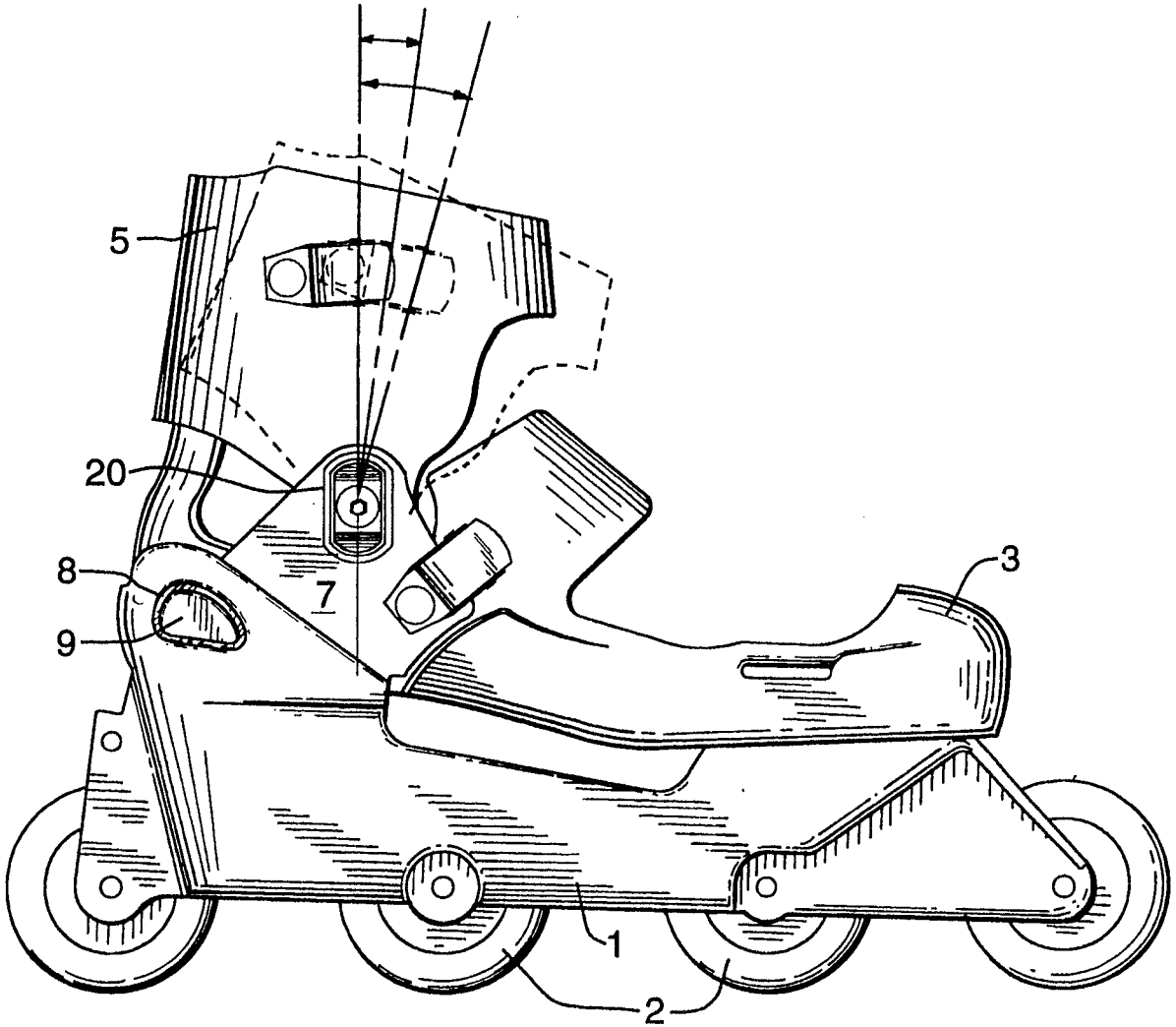
FIG. 4 is another side elevation view, showing pivoting of the cuff.
Figure 5:
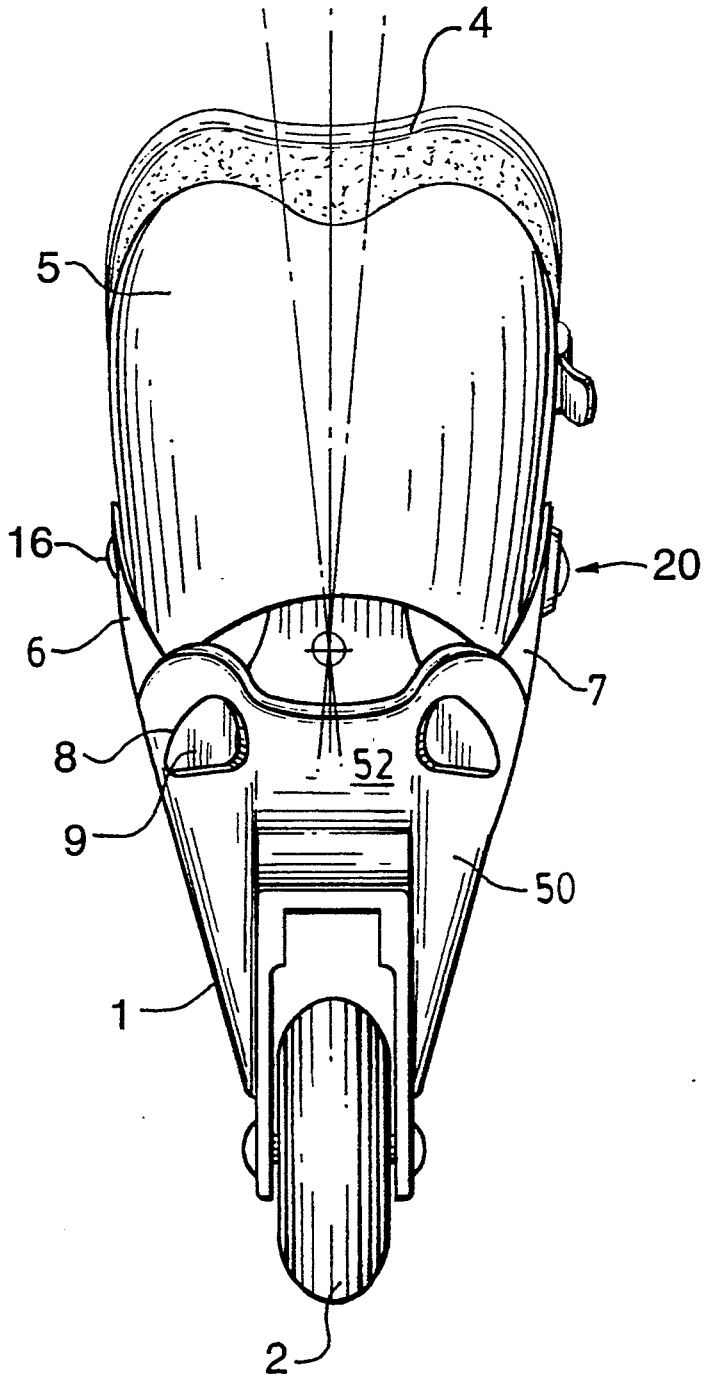
FIG. 5 is a rear view of the skate, showing canting of the cuff.
Figure 14:
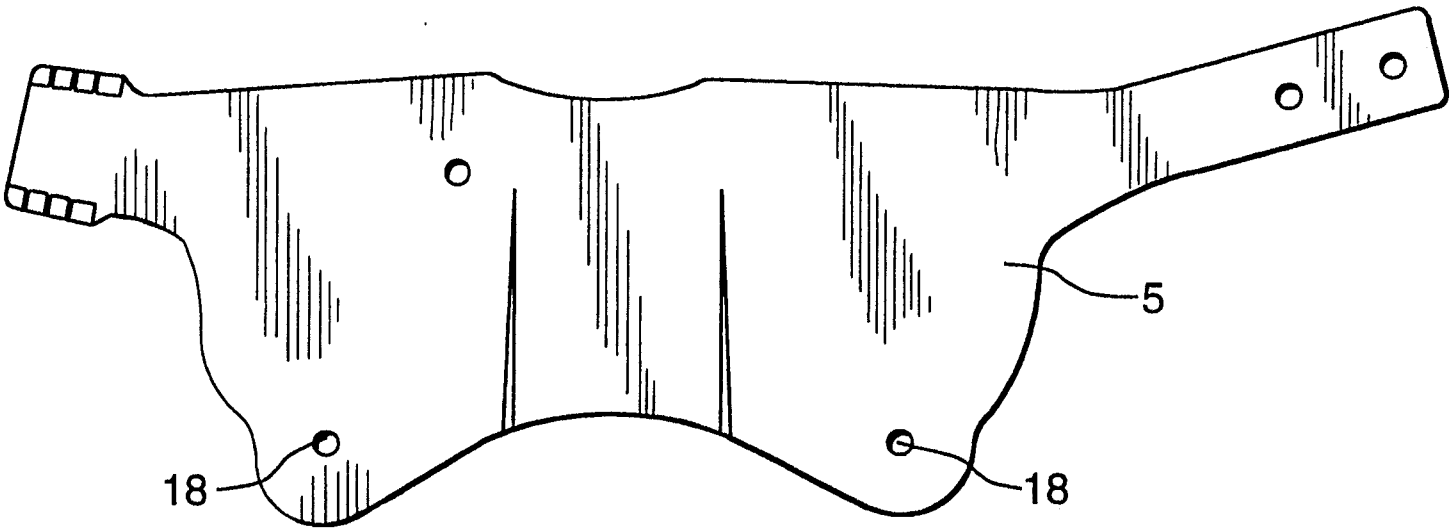
FIG. 14 is a plan view of the cuff, laid out flat.

The chassis wing portions 6 and 7 include pivot holes 14. The cuff 5 (shown by itself in FIG. 14, laid out flat) is pivotally connected to the wing portions, such as via plastic rivets 16 which pass through the pivot holes 14 and corresponding pivot holes 18 in the cuff. The pivotal connections preferably are in alignment with the user's malleoli, to permit dorsal/plantar flexion with minimal resistance. This pivotal movement of the cuff relative to the chassis is shown in FIG. 4.

The cuff overlies tabs 19 which project upwardly from the boot, to support the tabs, which in turn support the rear of the liner.

Figure 6:
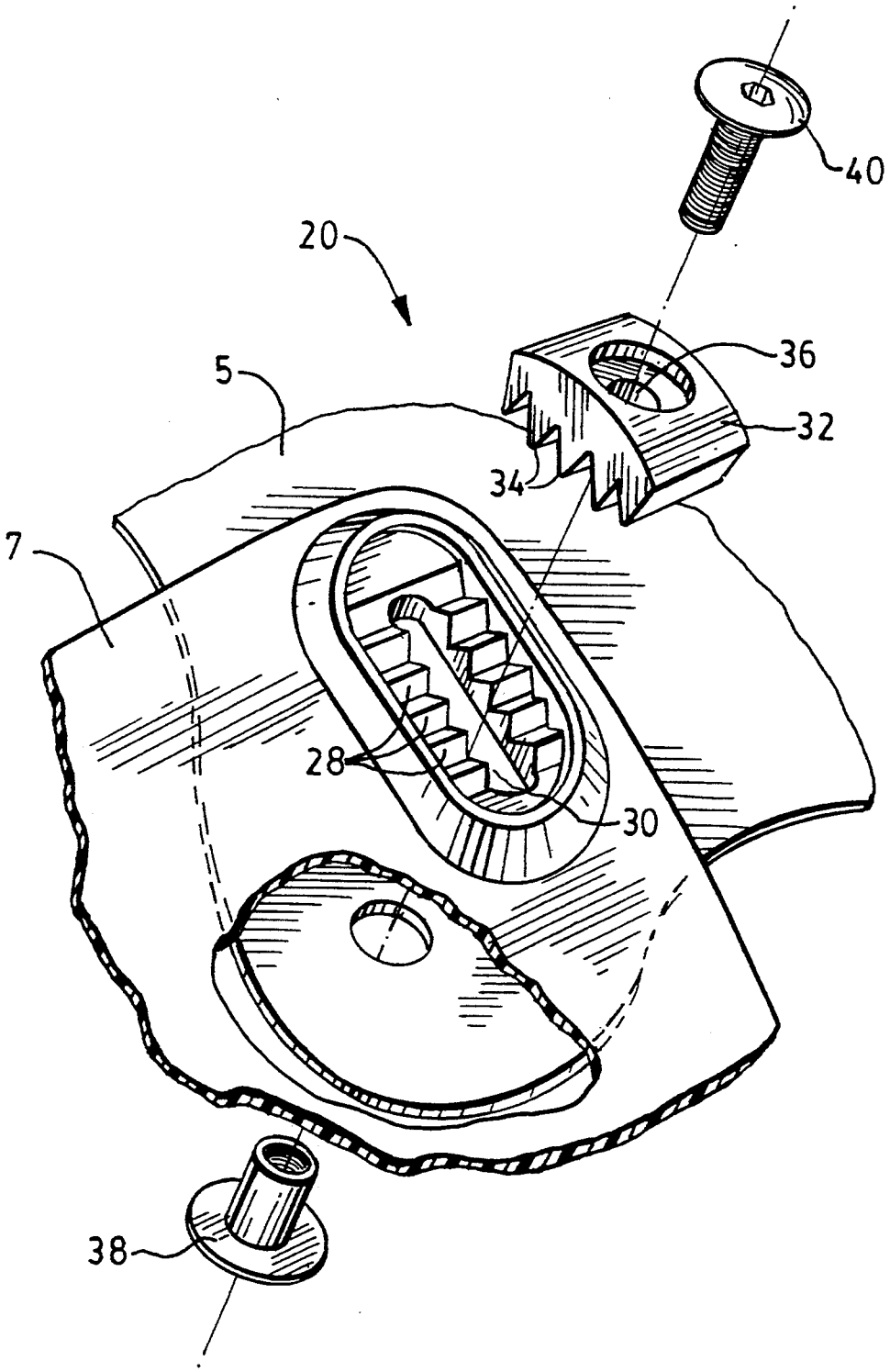
FIG. 6 is a perspective view of the "ribbed lock" assembly which permits the canting of the cuff.
Figure 8:
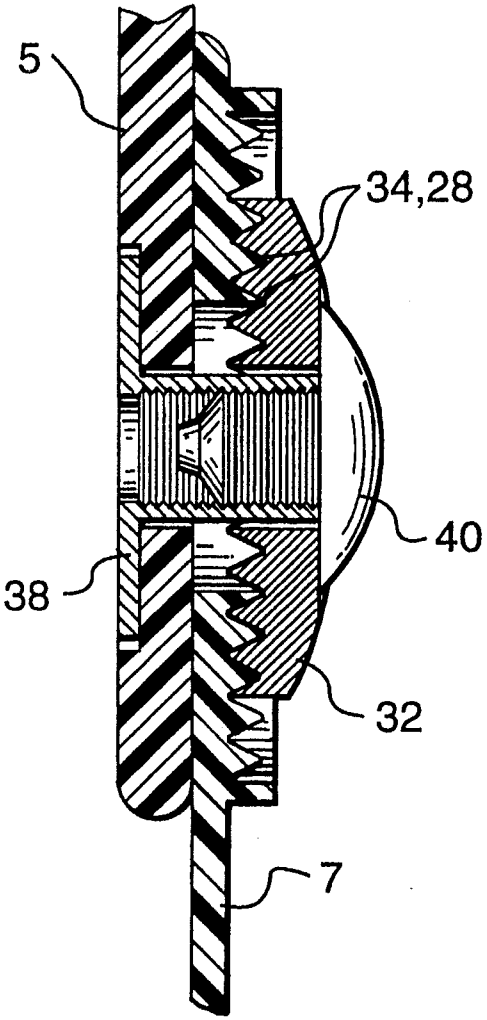
FIG. 8 is a cross-section of the assembled ribbed lock assembly.
Figure 7:
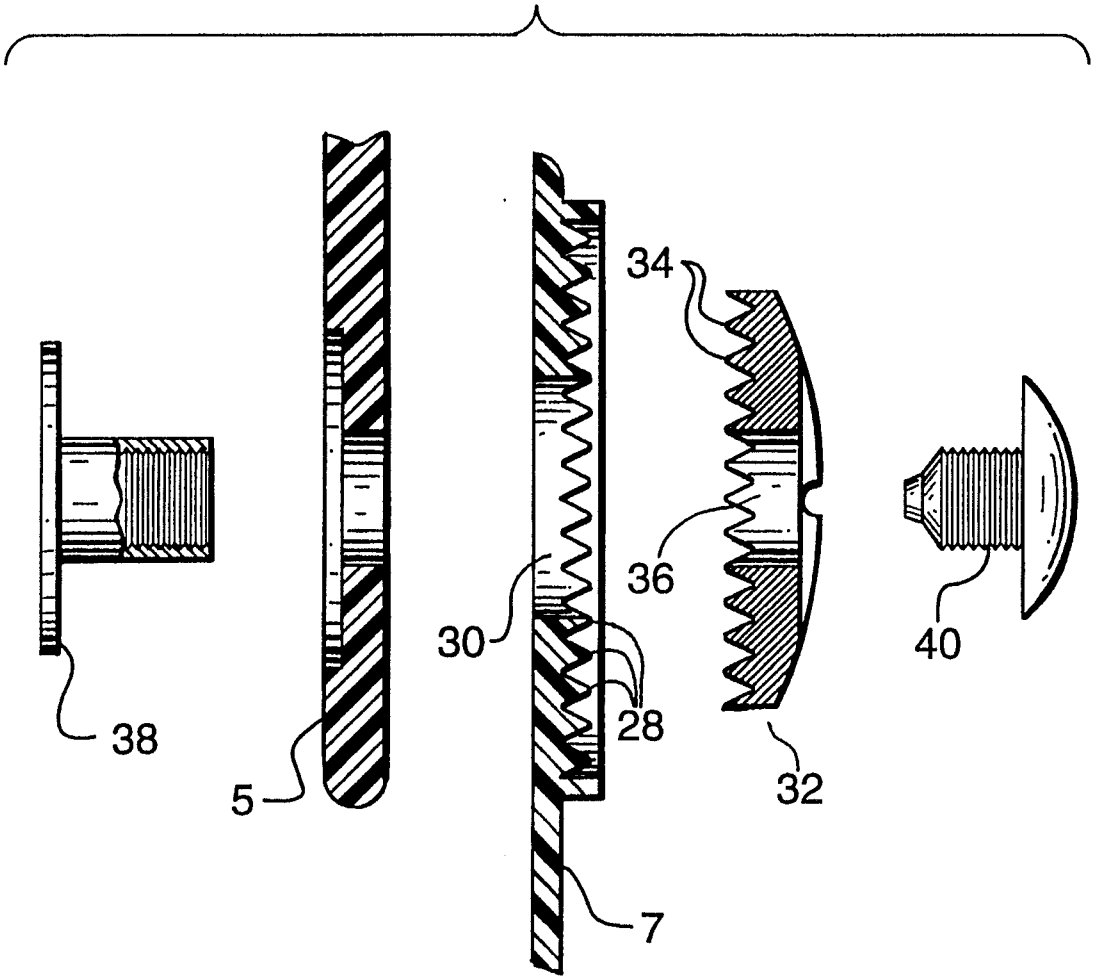
FIG. 7 is an exploded cross-section of the ribbed lock assembly.

Preferably, in order to allow canting (pronation/supination), one of the plastic rivets 16 is replaced by a ribbed lock assembly 20, as shown in detail in FIGS. 6, 7 and 8, which allows one side of the cuff to be positioned relatively higher or lower than the other side to provide the degree of canting preferred by the user. The ribbed lock assembly includes two rows of V-shaped ribs 28 moulded into the side wing, with a slotted opening 30 between the rows. An aluminum extrusion 32 with corresponding ribs 34 on the inside thereof has a hole 36 therein. A T-nut 38 and bolt 40 are used to secure the cuff and wing portion with the ribs 28 and 34 engaging each other in whatever position the user desires.

Figure 15:
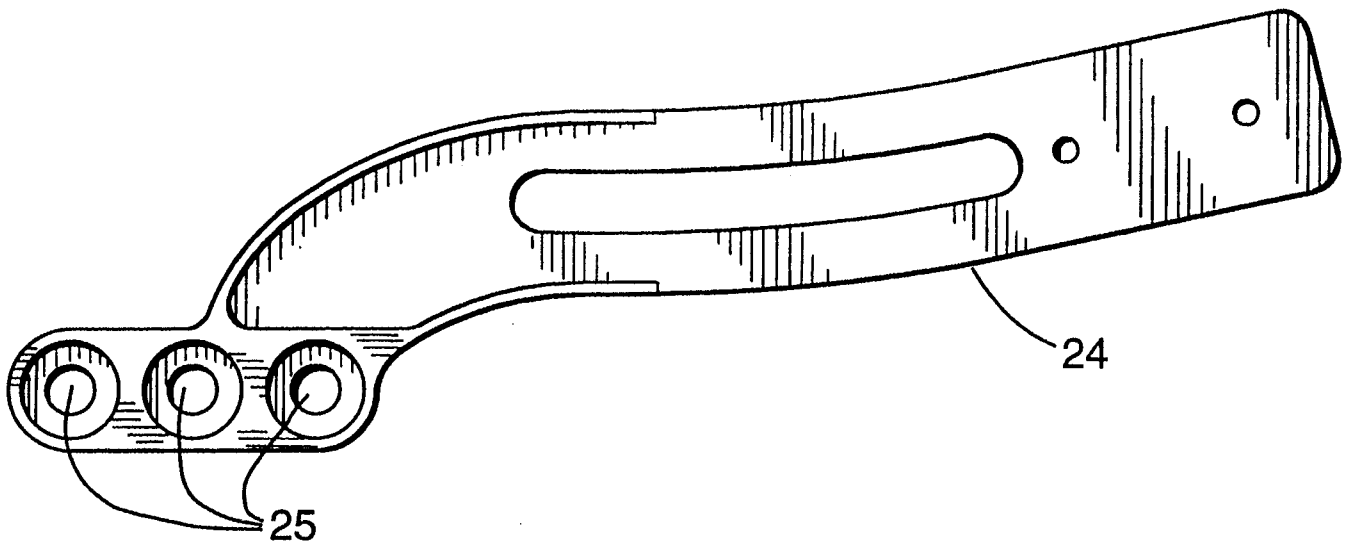
FIG. 15 is a plan view of the ankle strap, laid out flat.
Figure 16:
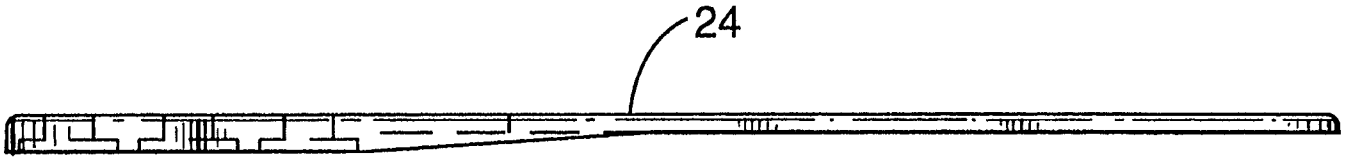
FIG. 16 is a side view of the ankle strap, corresponding to FIG. 15.

Suitable straps are used to tighten the skate onto the user's foot, such as a cuff strap 22, an ankle strap 24, and a forward strap 26. Conventional buckles are provided for the cuff strap and ankle strap, as seen in FIGS. 1 and 3 only. In the case of the forward strap, it is convenient to simple provide slots 27 in the boot, and to route the strap through the slots in zig-zag fashion as illustrated, and then using any suitable fastening means such as hook and pile material (e.g. VELCRO (trademark)). Preferably, one of the straps, i.e. the ankle strap 24 (shown by itself in FIGS. 15 and 16), has its opposite ends directed generally towards the heel box area, such that tightening of the strap pulls a user's heel directly into the heel box area. Since the heel box is defined by and integral with the hard plastic of the chassis, this produces a very solid anchoring of the user's heel in the heel box. Since typically about 70% of the energy transfer from the user to the ground takes place in the heel region (as opposed to ice skating where more of the energy transfer takes places towards the toe of the skate), this structure and the resulting solid anchoring of the heel in the heel box provides excellent energy transfer and therefore excellent performance. The strap 24 preferably has several holes 25 to provide overall length adjustment in addition to the adjustment permitted via the conventional buckles which are employed, and/or to allow the same strap to be used over a range of boot sizes.

Figure 17:
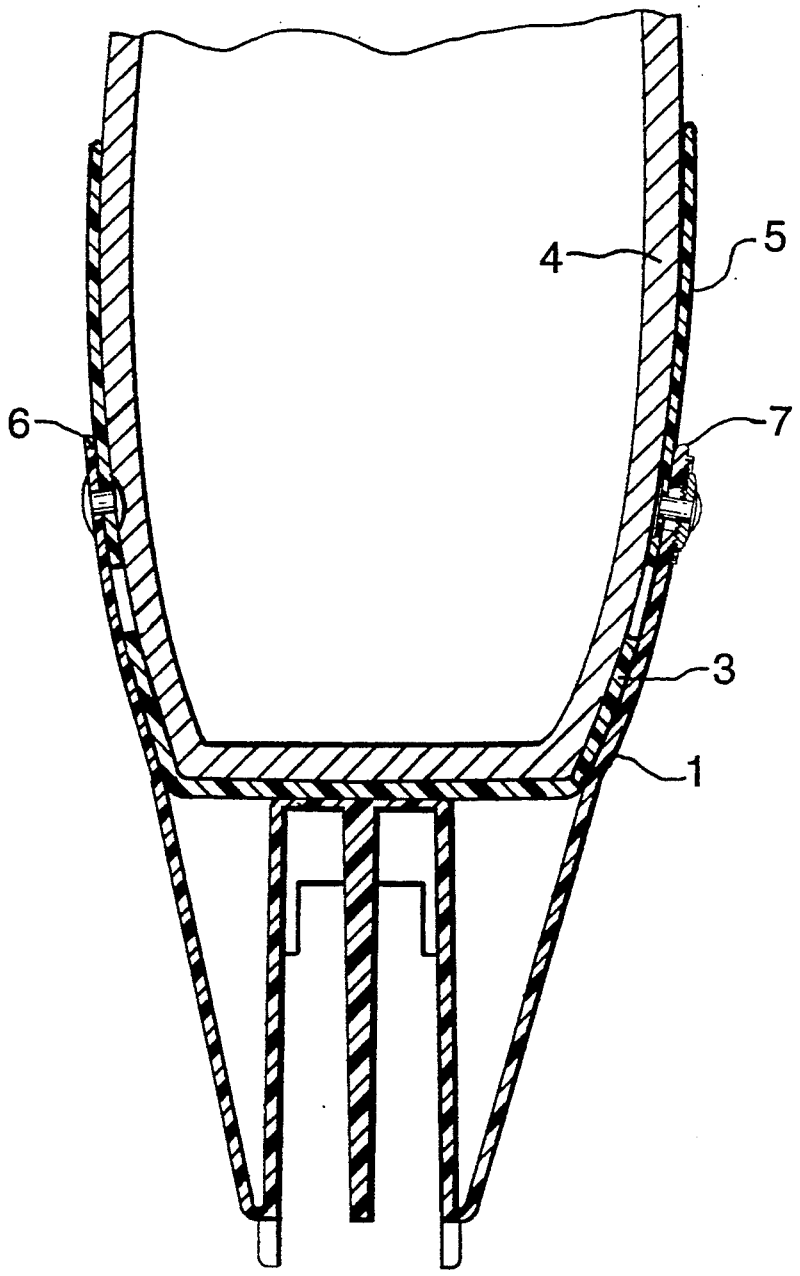
FIG. 17 is a lateral cross-section showing the chassis, boot, cuff and liner.

As can be seen in FIG. 17, the cuff is positioned inside the wing portions, and the boot and the cuff preferably are generally complementary in shape and thickness, thereby presenting generally flush interior surfaces to the liner. This enhances user comfort and reduces wear on the liner.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed as the invention is:

1. An in-line skate, comprising:

a rigid plastic chassis having in-line wheels rotatably mounted thereon and extending downwardly therefrom, said chassis having a main portion with an upper surface and front and rear ends, integral wing portions extending upwardly from the main portion on either side thereof adjacent said rear end thereof, and an integral heel portion between said wing portions, said main portion, heel portion and wing portions together defining a heel box area;

a plastic boot secured to said chassis upper surface, positioned inside and extending forwardly from said heel box area, and including side and rear portions;

a plastic cuff wrapping around either side and the rear portion of said boot and extending above said boot, pivotally connected to each wing portion of said chassis;

a soft flexible padded sock-like liner positionable inside said boot and said cuff; and strap means for securing said cuff, boot and chassis inwardly against said liner to firmly secure a user's foot.

2. An in-line skate as recited in claim 1, said strap means including at least one strap secured at one end to one of said wing portions, passable across the front of a user's ankle and securable to the opposite wing, the opposite ends of said strap being directed generally towards said heel box area, whereby tightening of said strap pulls a user's heel directly into said heel box area.

3. An in-line skate as recited in claim 1, where said boot is secured to said chassis at forward and rear fastener locations, said forward fastener location including means whereby said boot may be secured to said chassis in a range of lateral positions, so as to provide a variable toeing in or toeing out of the boot relative to the chassis.

4. An in-line skate as recited in claim 1, where said pivotal connection between said cuff and said wing portions includes adjustment means on at least one side, whereby the height of the cuff relative to the wing portion on that side may be adjusted, thereby permitting adjustment of the degree of canting.

5. An in-line skate as recited in claim 1, where said cuff is positioned inside said wing portions, and where said boot and said cuff are generally complementary in shape and thickness, thereby presenting generally flush interior surfaces to said liner.

* * * * *